US010439331B2

(12) United States Patent
Maesoba et al.

(10) Patent No.: US 10,439,331 B2
(45) Date of Patent: Oct. 8, 2019

(54) SHIELD CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Hiroyoshi Maesoba, Mie (JP); Toshifumi Ichio, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 16/314,472

(22) PCT Filed: Jun. 19, 2017

(86) PCT No.: PCT/JP2017/022481
§ 371 (c)(1),
(2) Date: Dec. 31, 2018

(87) PCT Pub. No.: WO2018/008374
PCT Pub. Date: Jan. 11, 2018

(65) Prior Publication Data

US 2019/0157809 A1 May 23, 2019

(30) Foreign Application Priority Data

Jul. 4, 2016 (JP) ..... 2016-132301

(51) Int. Cl.
*H01R 13/6581* (2011.01)

(52) U.S. Cl.
CPC ..... *H01R 13/6581* (2013.01)

(58) Field of Classification Search
CPC ..... H01R 13/4223; H01R 13/648; H01R 13/6581
See application file for complete search history.

(56) References Cited

U.S. PATENT DOCUMENTS 5,632,634 A * 5/1997 Soes ..... H01R 24/40 439/101
6,171,150 B1 1/2001 Saito et al.
(Continued)

FOREIGN PATENT DOCUMENTS

JP 2009-277544 11/2009
JP 2013-251238 12/2013

OTHER PUBLICATIONS

International Search Report dated Aug. 29, 2017.

*Primary Examiner* — Briggitte R. Hammond
(74) *Attorney, Agent, or Firm* — Gerald E. Hespos; Michael J. Porco; Matthew T. Hespos

(57) ABSTRACT

It is aimed to provide a shield connector capable of avoiding enlargement. A shield terminal (40) includes inner conductors (41), a dielectric (42) surrounding the inner conductors (41) and an outer conductor (43) surrounding the dielectric (42). A housing (10) includes a cavity (14) for accommodating the shield terminal (40), a ground plate mounting portion (18) into which a ground plate (100) is to be mounted, and a separation wall (21) separating the ground plate mounting portion (18) and the cavity (14). A ground terminal (70) is arranged across the separation wall (21). The ground terminal (70) includes an outer conductor contact piece (71) configured to enter the cavity (14), a ground plate contact piece (72) configured to enter the ground plate mounting portion (18) and a coupling piece (73) coupling the ground plate contact piece (72) and the outer conductor contact piece (71).

2 Claims, 11 Drawing Sheets

(56) References Cited

U.S. PATENT DOCUMENTS

| | | | | |
|---|---|---|---|---|
| 7,597,563 | B2 * | 10/2009 | Shinkawa | H01R 4/4809 439/98 |
| 8,187,036 | B2 * | 5/2012 | Fujiwara | H01R 9/0518 439/578 |
| 8,221,163 | B2 * | 7/2012 | Kawakami | H01R 13/6593 439/607.13 |
| 8,790,134 | B2 * | 7/2014 | Motohashi | H01R 9/0527 439/585 |
| 8,870,597 | B2 * | 10/2014 | Kawakami | H01R 13/6471 439/607.41 |
| 8,986,041 | B2 * | 3/2015 | Oka | H01R 9/032 439/374 |
| 2009/0011661 | A1 | 1/2009 | Imai | |
| 2009/0093170 | A1 | 4/2009 | Shinkawa et al. | |

* cited by examiner

SHIELD CONNECTOR

BACKGROUND

Field of the Invention

The invention relates to a shield connector.

Related Art

Japanese Unexamined Patent Publication No. 2009-277544 discloses a shield connector that is used for a high-frequency circuit, such as a GPS antenna circuit, and includes an electrical connection element, a housing having a cavity for accommodating the electrical connection element and a shield cover to be mounted externally on the housing. The electrical connection element is composed of an inner conductor, a dielectric surrounding the inner conductor and an outer conductor surrounding the dielectric. The shield cover includes a contact piece capable of contacting the outer conductor and is connected to a ground circuit conductive path of a circuit board.

The above-described shield cover is mounted to cover the entire outer surface of the housing. This design is problematic in that the external dimensions of the entire connector become large.

The invention was completed on the basis of the above situation and aims to provide a shield connector capable of avoiding enlargement.

SUMMARY

The invention is directed to a shield connector with a shield terminal including an inner conductor, a dielectric surrounding the inner conductor and an outer conductor surrounding the dielectric. The shield connector also has a connector housing including a cavity for accommodating the shield terminal. The connector housing has a ground plate mounting portion, and a ground plate is mounted into the ground plate mounting portion. A separation wall separates the ground plate mounting portion and the cavity, and a ground terminal is arranged across the separation wall. The ground terminal includes an outer conductor contact piece configured to contact the outer conductor by entering the cavity, a ground plate contact piece configured to contact the ground plate by entering the ground plate mounting portion and a coupling piece coupling the ground plate contact piece and the outer conductor contact piece.

According to the above configuration, the inner conductor is shielded by the outer conductor and the outer conductor is grounded to the ground plate via the ground terminal. Thus, the influence of noise is reduced. Further, the ground terminal includes the outer conductor contact piece configured to enter the cavity. The ground plate contact piece is configured to enter the ground plate mounting portion and the coupling piece coupling the contact pieces and is arranged across the separation wall. Accordingly, a small ground terminal can be used. Thus, even if the ground terminal is mounted into the connector housing, the entire shield connector need not be enlarged.

The coupling piece may resiliently sandwich the separation wall in a wall thickness direction and may include a ground plate side surface portion and a cavity side surface portion to be arranged along a wall surface of the separation wall on the ground plate mounting portion side and a wall surface of the separation wall on the cavity side. Additionally, each of the ground plate contact piece and the outer conductor contact piece may be connected to one end of the corresponding one of the ground plate side and cavity side surface portions and may extend deflectably in a direction away from the separation wall. The ground plate contact piece and the outer conductor contact piece are deflected and deformed when contacting the ground plate and the outer conductor. If supporting points of deflection of the ground plate contact piece and the outer conductor contact piece are proximate, the deflection of one affects the other and contact reliability with the ground plate and the outer conductor may be reduced. In that respect, according to the above configuration, one end of each of the ground plate side and cavity side surface portions serves as a supporting point of deflection of the corresponding one of the ground plate contact piece and the outer conductor contact piece and the surface portions are arranged along the wall surfaces of the separation wall. Thus, the separation wall is present between the supporting points of deflection of the ground plate contact piece and the outer conductor contact piece. Thus, the separation wall ensure that deflection of the ground plate contact piece and the outer conductor contact piece do not affect each other.

DETAILED DESCRIPTION

One embodiment of the invention is described with reference to FIGS. 1 to 13. A shield connector for high-speed communication of an automotive vehicle is illustrated in this embodiment, and includes a housing 10, a shield terminal 40 to be mounted into the housing 10, and a ground terminal 70 to be mounted into the housing 10. Note that, in the following description, a mounting direction (leftward direction of FIGS. 1 and 2) of the shield terminal 40 and the ground terminal 70 into the housing 10 is referred to as a forward direction concerning a front-rear direction, and a vertical direction is based on FIGS. 1 and 2.

Figure 5:
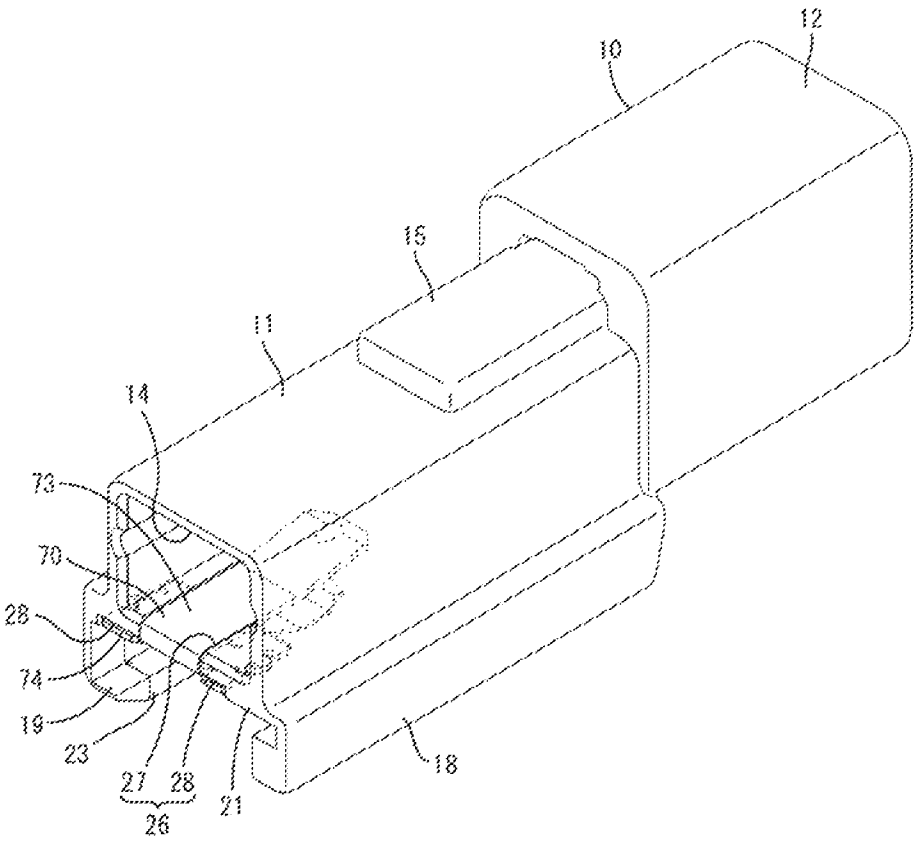
FIG. 5 is a perspective view viewed from the rear-upper side showing a state where the ground terminal is mounted in the housing.
Figure 6:
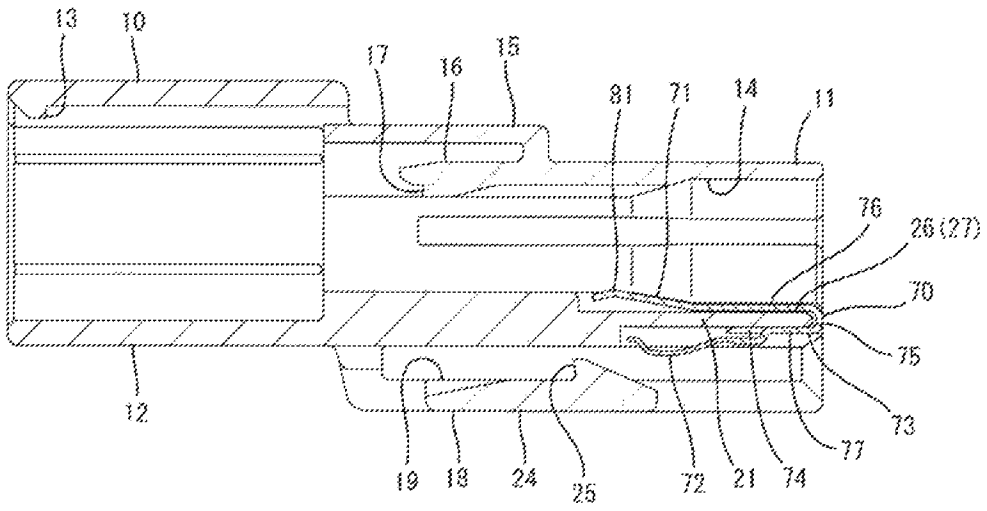
FIG. 6 is a section showing the state where the ground terminal is mounted in the housing.

The housing 10 is made of synthetic resin and includes, as shown in FIGS. 5 and 6, a housing body 11 substantially in the form of a rectangular tube and a receptacle 12 substantially in the form of a rectangular tube slightly larger than the housing body 11 and projecting forward from the front end of the housing body 11

Figure 2:
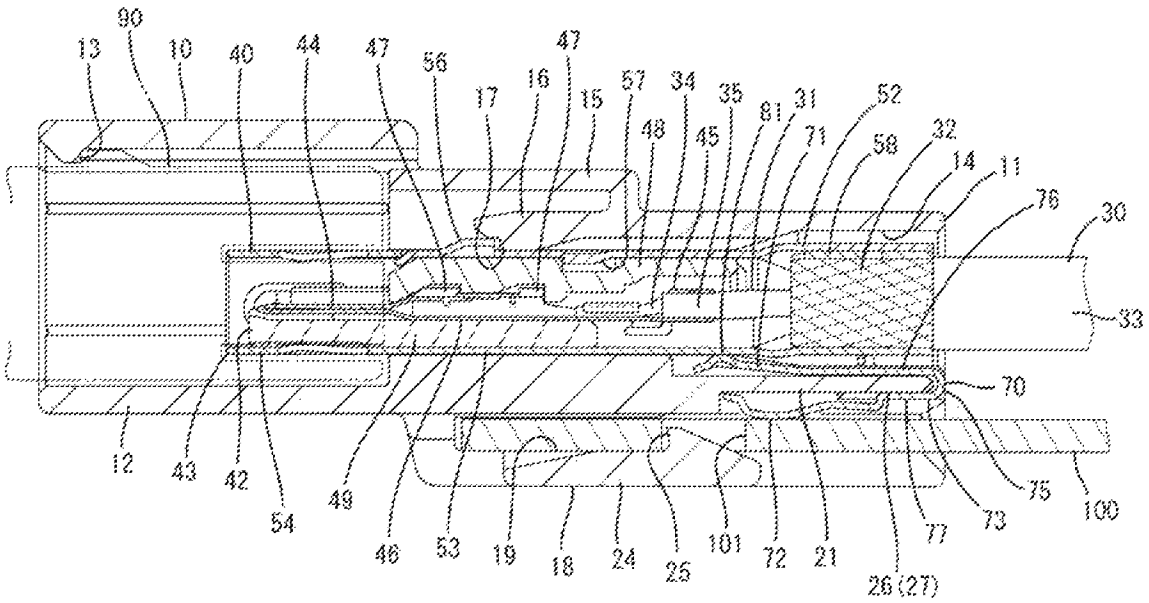
FIG. 2 is a section of the connector having a ground plate mounted in a housing from a state of FIG. 1.

As shown in FIG. 2, a lock 13 projects on an inner surface of a front end part of an upper wall of the receptacle 12. A mating housing 90 is fit into the receptacle 12. The mating housing 90 is held fit in the receptacle 12 by being locked by the lock 13. The housing body 11 extends longer in the front-rear direction than the receptacle 12 and includes a cavity 14 inside. The shield terminal 40 is inserted into the cavity 14 from behind.

A lance forming portion 15 bulges on a front part of an upper wall of the housing body 11. The inside of the lance forming portion 15 is a flat space extending in a horizontal direction (front-rear direction), faces the receptacle 12 and communicates with the cavity 14. The lance forming portion 15 is provided with a locking lance 16. The locking lance 16 is cantilevered forward from a back wall of the lance forming portion 15, and is deflectable and deformable in the vertical direction. A locking projection 17 projects down (toward the cavity 14) on a front end part (tip) of the locking lance 16. The shield terminal 40 is resiliently locked by the locking lance 16 and held retained in the cavity 14.

Figure 7:
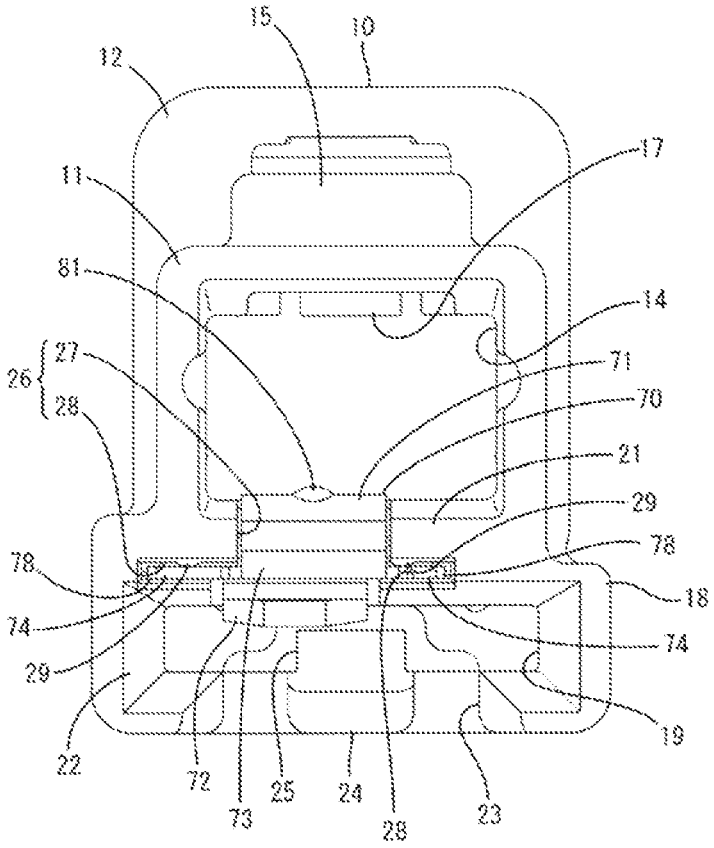
FIG. 7 is a back view showing the state where the ground terminal is mounted in the housing.

A ground plate mounting portion 18 is provided on a lower end part of the housing body 11. The ground plate mounting portion 18 includes a ground plate insertion space 19 inside. The ground plate insertion space 19 is a flat space extending in the horizontal direction, extends in the front-rear direction side by side with the cavity 14 and is, as shown in FIG. 7, in the form of a slit open in the rear surface of the housing 10. A lateral width of the ground plate insertion space 19 is larger than that of the cavity 14. Thus, the ground plate mounting portion 18 is expanded to both left and right in the lower end part of the housing body 11.

The ground plate insertion space 19 and the cavity 14 are partitioned by a separation wall 21. The separation wall 21 is continuous with a lower wall of the receptacle 12 in the front-rear direction and constitutes an expanded upper wall part in the ground plate mounting portion 18. As shown in FIG. 7, a guiding surface 22 widened toward a rear side is provided on an opening edge part of the ground plate insertion space 19 in the rear surface of the ground plate mounting portion 18. A ground plate 100 is inserted into the ground plate insertion space 19 while being guided by the guiding surface 22.

As shown in FIG. 7, a groove portion 23 open in the rear end of a laterally central part is provided in a lower wall of the ground plate mounting portion 18, and a resilient lock portion 24 is provided to project into the groove portion 23. The resilient lock portion 24 is deflectable and deformable with parts coupled to both left and right end parts of the lower wall defining the groove portion 23 as supporting points. A lock projection 25 is provided to project upward (toward the ground plate insertion space 19) on a rear end part (tip part) of the resilient lock portion 24.

The ground plate 100 is a bracket connected to a vehicle body and, as shown in FIG. 2, inserted into the ground plate insertion space 19 from behind with plate surfaces thereof extending in the horizontal direction. The ground plate 100 is provided with a lock hole 101. The ground plate 100 is resiliently locked by the resilient lock portion 24 in a state properly inserted in the ground plate insertion space 19, and retained and held in the ground plate insertion space 19 by the entrance of the lock projection 25 of the resilient lock portion 24 into the lock hole 101.

Figure 4:
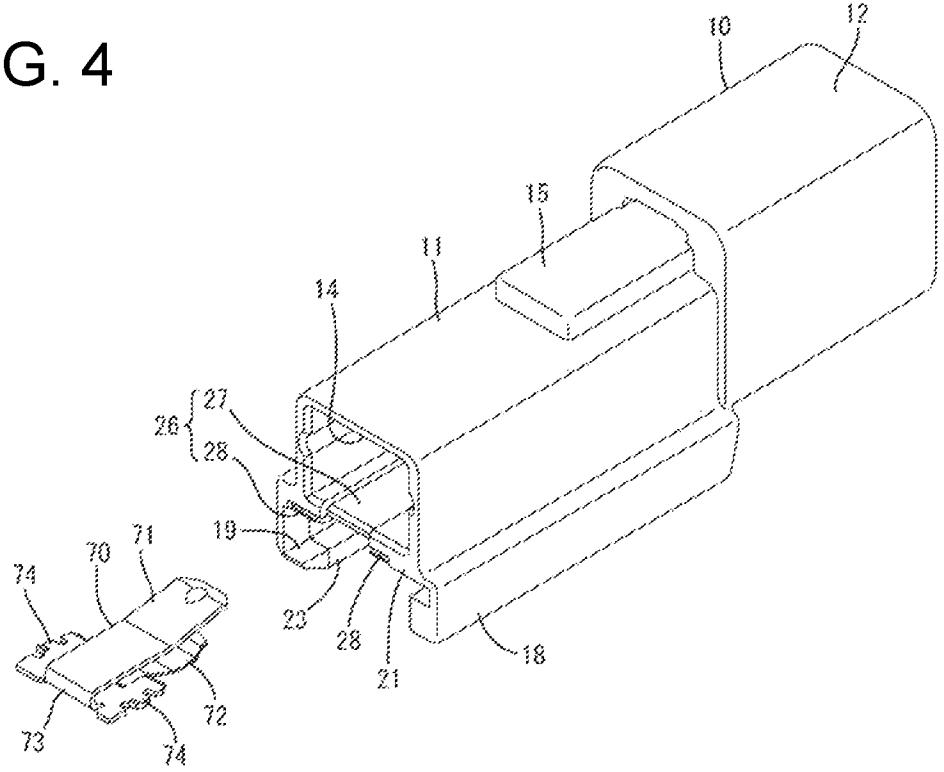
FIG. 4 is an exploded perspective view of the housing and a ground terminal viewed from a rear-upper side.

As shown in FIGS. 4 and 7, the separation wall 21 is provided with a ground terminal mounting portion 26. The ground terminal mounting portion 26 is eccentrically shifted to one side (left side of FIG. 7) from a lateral center of the housing 10 and includes a ground terminal fitting portion 27 recessed over the upper surface (surface facing toward the cavity 14), the rear end surface and the lower surface (surface facing toward the ground plate insertion space 19) of the separation wall 21. An upper part of the ground terminal fitting portion 27 is formed by recessing the upper surface of the separation wall 21 (lower surface of the cavity 14), a rear end part of the ground terminal fitting portion 27 is formed by recessing the rear end (including the guiding surface 22) of the separation wall 21, and a lower part of the ground terminal fitting portion 27 is formed by recessing the lower surface of the separation wall 21 (upper surface of the ground plate insertion space 19). Thus, the ground terminal mounting portion 26 is thinner than a surrounding part of the separation wall 21.

Further, as shown in FIG. 7, the ground terminal mounting portion 26 includes a pair of slit grooves 28 on both left and right sides of the ground terminal fitting portion 27. The slit grooves 28 are formed as flat grooves extending in the horizontal direction by being cut forward from the rear end surface of the separation wall 21. A holding projection 29 having a convex spherical surface is provided on an upper surface in the slit groove 28. The ground terminal 70 is held retained on the ground terminal mounting portion 26 by being externally fit on the ground terminal mounting portion 26 and having protruding pieces 74 to be described later press-fit into the slit grooves 28. In this case, a holding force for the ground terminal 70 is enhanced by pressing the protruding pieces 74 from above by the holding projections 29.

Figure 1:
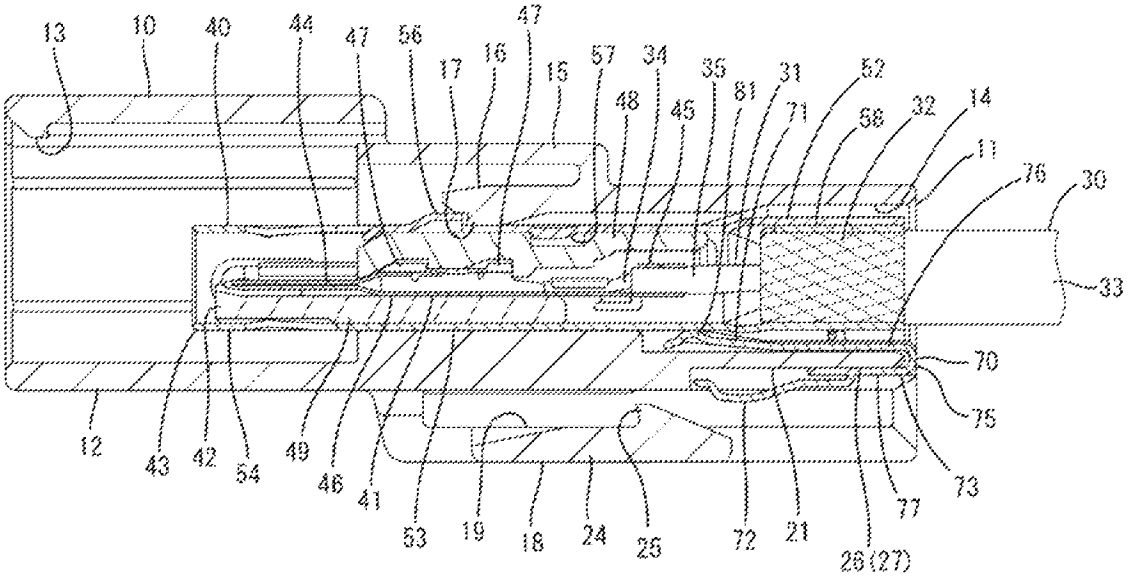
FIG. 1 is a section of a connector in one embodiment of the present invention.
Figure 8:
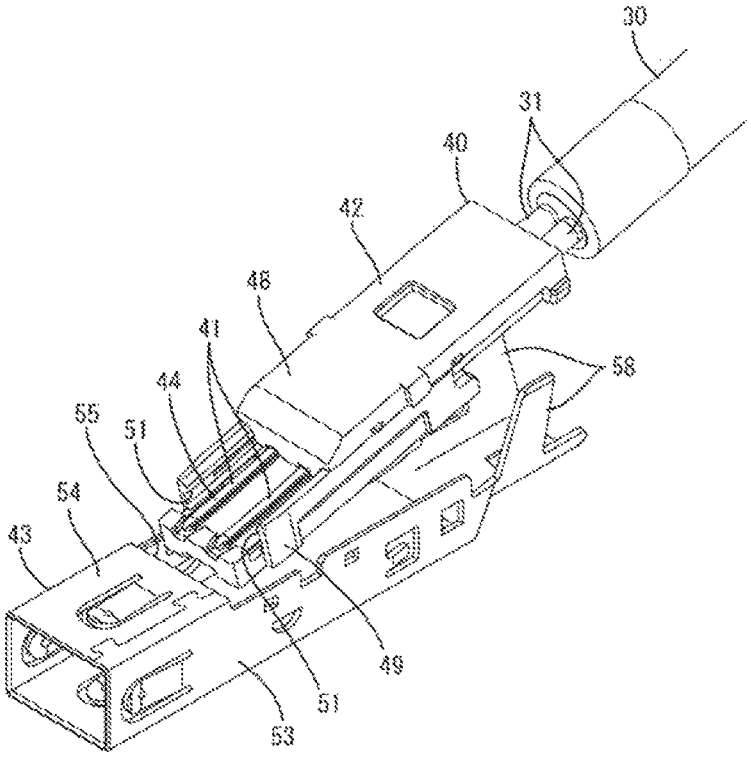
FIG. 8 is a perspective view showing an intermediate state while the shield terminal is being assembled.

As shown in FIGS. 1 and 8, the shield terminal 40 is composed of inner conductors 41, a dielectric 42 surrounding the outer peripheries of the inner conductors 41 and an outer conductor 43 surrounding the outer periphery of the dielectric 42. The inner conductors 41 are connected to a shielded cable 30 serving as a high-speed communication cable.

As shown in FIG. 1, the shielded cable 30 includes a plurality of (here, two (see FIG. 8)) signal wires 31, a braided wire 32 (shield layer) made of metal and collectively covering the respective signal wires 31 and an outer sheath 33 made of insulating resin and covering the braided wire 32. On an end part of the shielded cable 30, the braided wire 32 and the outer sheath 33 are stripped to expose the respective signal wires 31. The outer sheath 33 is exposed longer than the braided wire 32 to expose also the braided wire 32. Further, each signal wire 31 is a coated wire including a core 34 made of a copper wire or aluminum wire, and a coating 35 is stripped to expose the core 34.

The inner conductor 41 is a so-called male terminal fitting and integrally formed, such as by bending a conductive metal plate. As many inner conductors 41 as the respective signal wires 31 (here, two (see FIG. 8)) are provided for one shielded cable 30.

Specifically, the inner conductor 41 includes a pin-like tab portion 44 projecting forward, a barrel portion 45 located behind the tab portion 44 and to be electrically crimped and connected to the core 34 of the signal wire 31 and mechanically crimped and connected to the coating 35 of the signal wire 31, and a locked portion 46 located between the barrel portion 45 and the tab portion 44. The tab portion 44 is electrically connected to an unillustrated mating terminal mounted in the mating housing 90 when the housing 10 is connected to the mating housing 90. The locked portion 46 includes a projection 47 to be locked in a state where movements in the front-rear direction with respect to the dielectric 42 (upper dielectric 48 to be described later) are restricted.

The dielectric 42 is made of synthetic resin and composed of the upper dielectric 48 and a lower dielectric 49 which are vertically dividable. As shown in FIG. 8, the upper dielectric 48 is in the form of a plate substantially rectangular in a plan view, includes recessed parts for receiving the projections 47 of the inner conductors 41 on a lower surface and includes a recessed part for receiving a later-described projecting portion 57 of the outer conductor 43 on an upper surface (see FIG. 1). The respective inner conductors 41 are juxtaposed in a laterally partitioned state while locking the projections 47 to the lower surface of the upper dielectric 48, and expose the tab portions 44 forward of the front end of the upper dielectric 48.

As shown in FIG. 8, the lower dielectric 49 is likewise in the form of a plate substantially rectangular in a plan view, the front end thereof is located forward of that of the upper dielectric 48 and has a part for covering the tab portions 44 of the inner conductors 41. Lock claws 51 to be locked to the upper dielectric 48 are provided on both left and right end parts of the lower dielectric 49.

Figure 3:
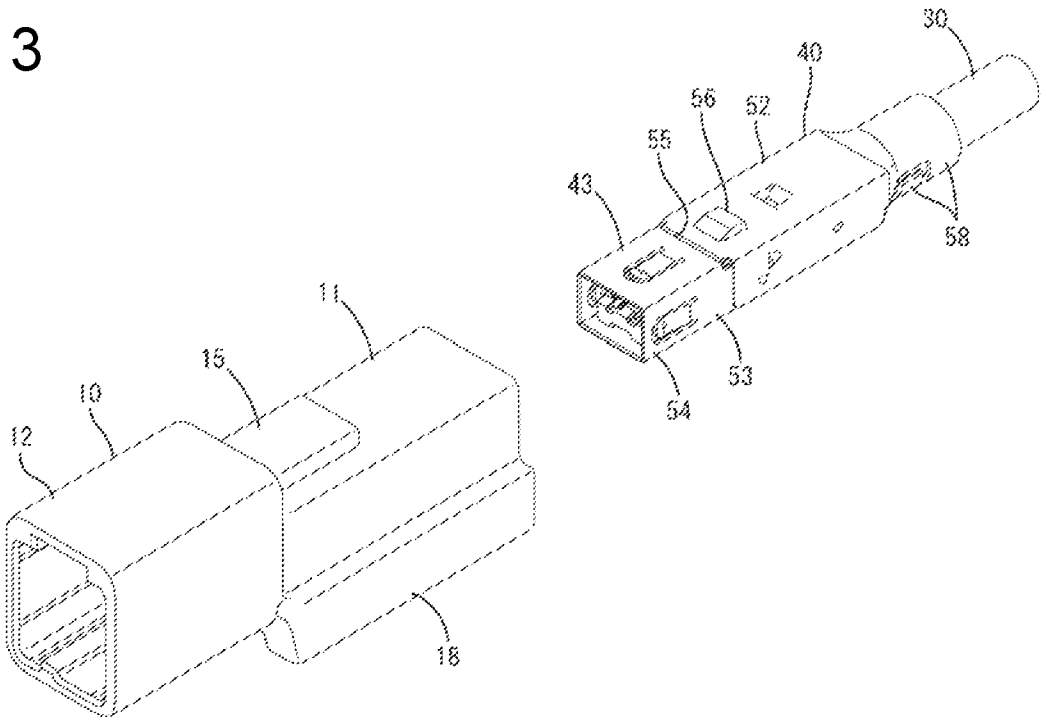
FIG. 3 is an exploded perspective view of the housing and a shield terminal viewed from a front-upper side.

The outer conductor 43 is a shell made of metal and formed, such as by bending a conductive metal plate. As shown in FIG. 3, the outer conductor 43 is composed of an upper outer conductor 52 and a lower outer conductor 53 which are vertically dividable. As shown in FIG. 8, the lower outer conductor 53 includes a tubular portion 54 in the form of a rectangular tube in a front end part and includes an opening 55 in an upper surface behind the tubular portion 54. The lower surface of a rear part of a lower wall part of the lower outer conductor 53 is a flat surface facing the ground terminal fitting portion 27 and capable of contacting the ground terminal 70 (see FIG. 2).

The upper outer conductor 52 includes a ceiling plate part for closing the opening 55 of the lower outer conductor 53 and side plate parts hanging down from both left and right ends of the ceiling plate part and to be locked to the outer conductor 53 (see FIG. 3). By locking the side plate parts of the upper outer conductor 52 to the lower outer conductor 53, the entire outer conductor 43 has a rectangular tube shape. As shown in FIG. 1, a lock receiving portion 56 is provided on a front end part of the ceiling plate part of the upper outer conductor 52 by being bent upwardly. The rear end of the lock receiving portion 56 is resiliently locked by the locking projection 17 of the locking lance 16, whereby the shield terminal 40 is retained in the cavity 14. Further, the projecting portion 57 is fixedly provided on the lower surface of the upper outer conductor 52. The projecting portion 57 enters the recessed part of the upper dielectric 48, whereby the dielectric 42 is held in the outer conductor 43.

In assembling the shield terminal 40, the inner conductors 41 are first connected to the end part of the shielded cable 30. Subsequently, the inner conductors 41 are locked to the upper dielectric 48 and the lower dielectric 49 is locked to be put on the upper dielectric 48. Subsequently, as shown in FIG. 8, the dielectric 42 is inserted into the tubular portion 54 of the lower outer conductor 53 through the opening 55 while being inclined downward toward the front. In the process of inserting the dielectric 42 (inserting process), the lower dielectric 49 slides on the upper surface of the lower wall part of the lower outer conductor 53 to guide an inserting operation of the dielectric 42 into the tubular portion 54 and prevent the breakage or the like of the tab portions 44 of the inner conductors 41 due to interference with the lower outer conductor 53. Thereafter, the upper outer conductor 52 is locked to the lower outer conductor 53 to close the opening 55. Further, crimping pieces 58 respectively provided on rear end parts of the upper and lower outer conductors 52, 53 are crimped to the braided wire 32 of the shielded cable 30 and the outer conductor 43 is electrically connected to the braided wire 32 (see FIG. 3).

Figure 9:
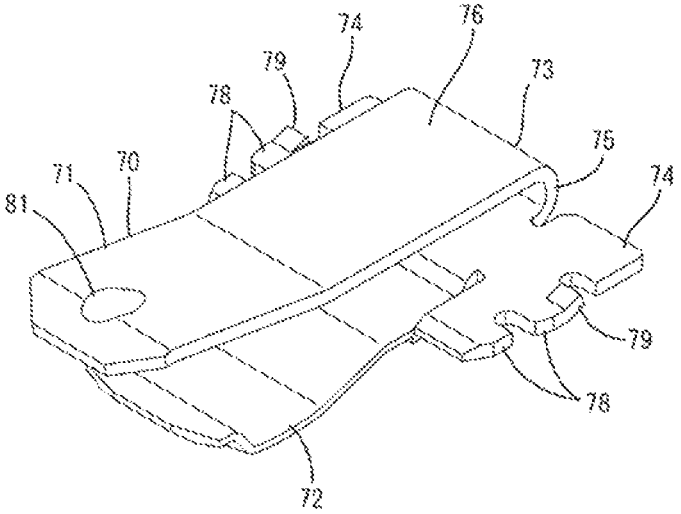
FIG. 9 is a perspective view of the ground terminal viewed from above.
Figure 10:
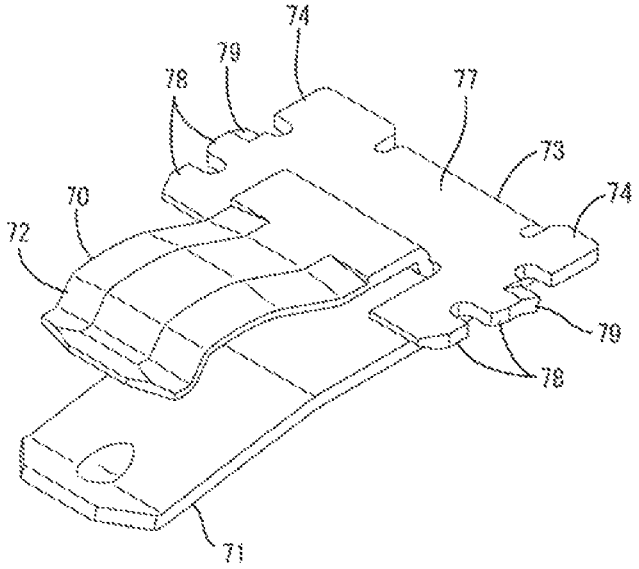
FIG. 10 is a perspective view of the ground terminal viewed from below.

The ground terminal 70 is integrally formed, such as by bending a conductive metal plate. As shown in FIG. 9, the ground terminal 70 is in the form of a plate piece as a whole and composed of an outer conductor contact piece 71 located on an upper side, a ground plate contact piece 72 located on a lower side, a coupling piece 73 coupling the ground plate contact piece 72 and the outer conductor contact piece 71 and a pair of the protruding pieces 74.

Figure 13:
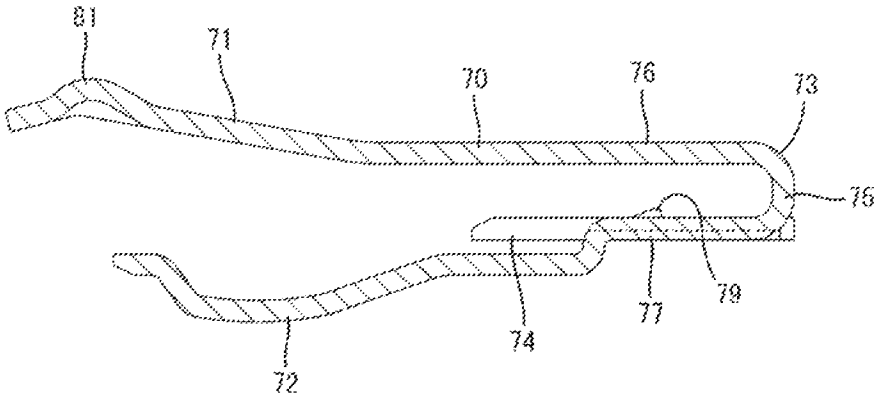
FIG. 13 is a section along A-A of FIG. 12.

The coupling piece 73 is arranged in a rear end part of the ground terminal 70, substantially U-shaped and open forward. As shown in FIGS. 6 and 13, the coupling piece 73 is composed of a curved portion 75 in the form of a curved surface facing a rear end part of the ground terminal fitting portion 27 (also the rear end of the separation wall 21), an upper surface portion 76 (surface portion on the cavity side) arranged substantially horizontally forward from the upper end of the curved portion 75 and arranged to be able to contact an upper surface part of the ground terminal fitting portion 27 (also the upper surface of the separation wall 21 (lower surface of the cavity 14)) along the front-rear direction, a lower surface portion 77 (surface portion on the ground plate side) arranged substantially horizontally forward from the lower end of the curved portion 75 and arranged to be able to contact a lower surface part of the ground terminal fitting portion 27 (also the lower surface of the separation wall 21 (upper surface of the ground plate insertion space 19)) along the front-rear direction. Here, the front end of the upper surface portion 76 constitutes a substantial supporting point of the deflection of the outer conductor contact piece 71. The front end of the lower surface portion 77 is located rearward of the front end of the upper surface portion 76 and constitutes a substantial supporting point of the deflection of the ground plate contact piece 72.

Figure 11:
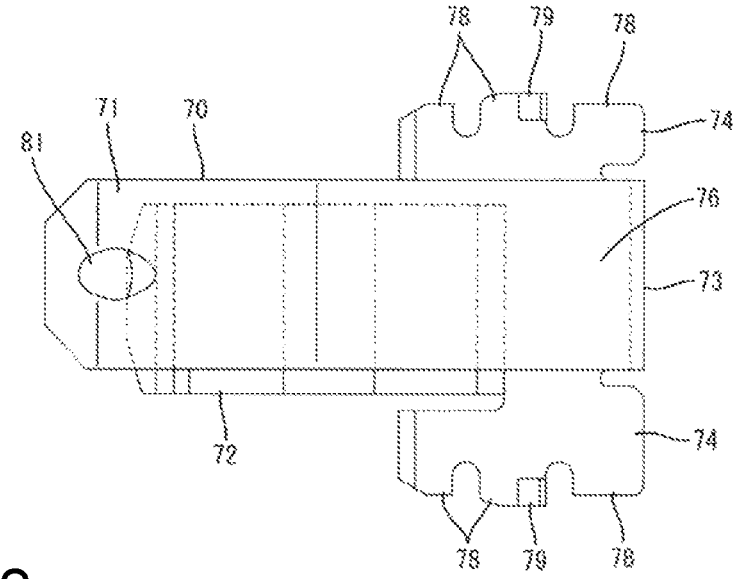
FIG. 11 is a plan view of the ground terminal.

As shown in FIG. 11, the pair of protruding pieces 74 are in the form of wings expanded to both front and rear sides from parts coupled to both left and right ends of the lower surface portion 77, and arranged to be coplanar and continuous with the lower surface portion 77 without any step. A plurality of biting protrusions 78 are provided side by side in the front-rear direction on the outer end edge (leading end edge in a protruding direction) of the protruding piece 74. The biting protrusion 78 located in a central part of the protruding piece 74 in the front-rear direction is provided with a retaining projection 79 formed by being cut and obliquely raised toward an upper-rear side. The protruding pieces 74 are inserted into the slit grooves 28 of the ground terminal mounting portion 26 from behind, the biting protrusions 78 are press-fit to bite into edge parts of the slit grooves 28 and the retaining projections 79 are retained and locked to groove surfaces of the slit grooves 28, whereby the ground terminal 70 is firmly held in the ground terminal mounting portion 26 of the separation wall 21 (see FIG. 7).

Figure 12:
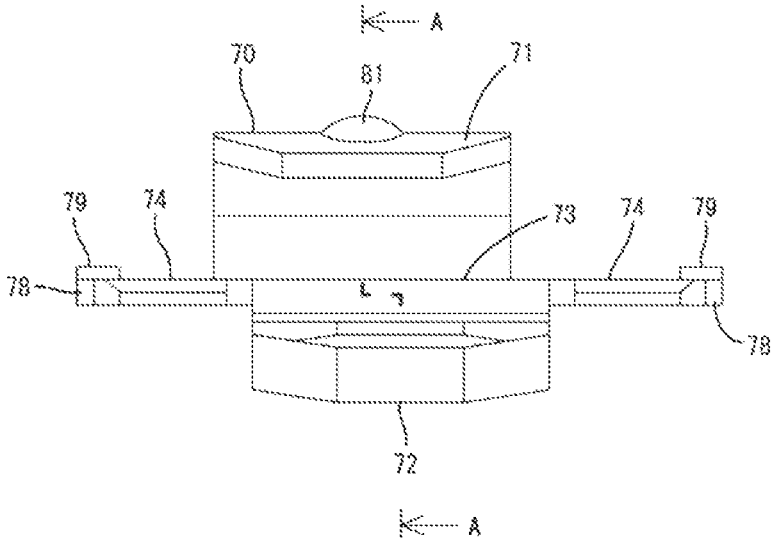
FIG. 12 is a back view of the ground terminal.

As shown in FIG. 13, the outer conductor contact piece 71 is in the form of a strip piece, and a front end part thereof is inclined downward toward the front after the outer conductor contact piece 71 is inclined upward toward the front from the front end of the upper surface portion 76. An embossed contact point portion 81 is provided to bulge upward on a top part of the outer conductor contact piece 71. As shown in FIG. 2, the contact point portion 81 can contact the lower surface of the rear part of the lower wall part of the lower outer conductor 53. Note that, as shown in FIG. 12, a widthwise center of the outer conductor contact piece 71 is eccentrically shifted to one side from a widthwise center of the entire ground terminal 70.

As shown in FIG. 13, the ground plate contact piece 72 is in the form of a strip piece and extends substantially horizontally forward and is concavely curved downward after slightly projecting downward from the front end of the lower surface portion 77, and a front end part thereof is substantially horizontally arranged. As shown in FIG. 2, the lower end of a curved part of the ground plate contact piece 72 can contact the upper surface of the ground plate 100.

The rear end of the ground plate contact piece 72 (front end of the lower surface portion 77) is located at a position overlapping the protruding pieces 74 and behind the rear end of the outer conductor contact piece 71 (front end of the upper surface portion 76) in the front-rear direction. As shown in FIG. 12, a widthwise center of the ground plate contact piece 72 is set substantially at the same position as that of the entire ground terminal 70. Thus, the ground plate contact piece 72 and the outer conductor contact piece 71 are shifted from each other in a width direction.

Next, an assembling procedure, functions and effects of the shield connector of this embodiment are described.

First, as shown in FIGS. 4 to 7, the ground terminal 70 is mounted on the ground terminal mounting portion 26 of the separation wall 21 from behind. At this time, the ground terminal 70 is arranged to cover the upper surface part, the rear end part and the lower surface part of the ground terminal fitting portion 27 across the rear end part of the separation wall 21. When the ground terminal 70 is properly mounted on the ground terminal mounting portion 26, the upper surface portion 76 is arranged along the upper surface part of the ground terminal fitting portion 27, the lower surface portion 77 is arranged along the lower surface part of the ground terminal fitting portion 27 and the protruding pieces 74 are press-fit into the slit grooves 28 via the biting protrusions 78 to be locked. Further, the contact point portion 81 of the outer conductor contact piece 71 is arranged to enter the cavity 14 from below, and the lower end of the curved part of the ground plate contact piece 72 is arranged to enter the ground plate insertion space 19 from above.

Subsequently, as shown in FIG. 1, the shield terminal 40 connected to the end part of the shielded cable 30 is inserted into the cavity 14 of the housing body 11 from behind. In the process of inserting the shield terminal 40, the lower wall of the lower outer conductor 53 interferes with the contact point portion 81 to deflect and deform the outer conductor contact piece 71 downward (into the recess of the ground terminal fitting portion 27).

When the shield terminal 40 is properly inserted into the cavity 14, the lock receiving portion 56 is resiliently locked by the locking lance 16 and the contact point portion 81 contacts the lower surface of the rear part of the lower wall of the lower outer conductor 53 while the outer conductor contact piece 71 is kept deflected. At this time, the front end part of the outer conductor contact piece 71 is inclined downward and arranged near the upper surface part of the ground terminal fitting portion 27.

Subsequently, the ground plate 100 is inserted into the ground plate insertion space 19 of the ground plate mounting portion 18 from behind. The ground plate 100 interferes with the lock projection 25 in the inserting process thereof to deflect and deform the resilient lock portion 24 downward. When the ground plate 100 is properly inserted into the ground plate insertion space 19 as shown in FIG. 2, the resilient lock portion 24 resiliently returns, the lock projection 25 is fit into the lock hole 101 of the ground plate 100 from below and the ground plate 100 is locked to the ground plate mounting portion 18. Further, the ground plate contact piece 72 is deflected and deformed upward (into the recess of the ground terminal fitting portion 27) by being pressed by the ground plate 100 being inserted into the ground plate insertion space 19, and the lower end of the curved part of the ground plate contact piece 72 contacts the upper surface of the ground plate 100. In this way, the outer conductor 43 is electrically connected to the ground plate 100 via the ground terminal 70 and grounded to the vehicle body by the ground plate 100.

In a state where the outer conductor contact piece 71 is pressed by the outer conductor 43 and deflected and deformed with the front end of the upper surface portion 76 substantially as a supporting point, the coupling piece 73 sandwiches the ground terminal fitting portion 27 (separation wall 21) in the vertical direction and the upper surface portion 76 is arranged to be able to come into contact with the upper surface part of the ground terminal fitting portion 27 over a predetermined range in the front-rear direction, whereby it is suppressed that the deflection of the outer conductor contact piece 71 affects the ground plate contact piece 72. Similarly, in a state where the ground plate contact piece 72 is pressed by the ground plate 100 and deflected and deformed with the front end of the lower surface portion 77 substantially as a supporting point, the coupling piece 73 sandwiches the ground terminal fitting portion 27 in the vertical direction and the lower surface portion 77 is arranged to be able to come into contact with the lower surface part of the ground terminal fitting portion 27 over a predetermined range in the front-rear direction, whereby it is suppressed that the deflection of the ground terminal contact piece 72 affects the outer conductor contact piece 71. Thus, contact reliability when the outer conductor contact piece 71 contacts the outer conductor 43 and contact reliability when the ground plate contact piece 72 contacts the ground plate 100 are ensured.

As described above, according to this embodiment, since the inner conductors 41 are shielded by the outer conductor 43 and the outer conductor 43 is grounded to the ground plate 100 via the ground terminal 70, the influence of noise is reduced. Further, since the ground terminal 70 includes the outer conductor contact piece 71 configured to enter the cavity 14, the ground plate contact piece 72 configured to enter the ground plate mounting portion 18 and the coupling piece 73 coupling these ground plate contact piece 72 and outer conductor contact piece 71 and is arranged across the separation wall 21, the ground terminal 70 having a small size can be used. Thus, even if the ground terminal 70 is mounted into the housing 10, the entire shield connector needs not be enlarged. As a result, it is possible to provide a small-size shield connector including the ground plate 100 and suitable for high-speed communication. Further, the ground terminal 70 can be easily mounted on the separation wall 21 by a one-touch operation.

OTHER EMBODIMENTS

Other embodiments of the present invention are briefly described.

(1) Although the ground terminal includes the outer conductor contact piece, the ground plate contact piece, the coupling piece and the protruding pieces in the above embodiment, the ground terminal may include an additional part in the case of the present invention if enlargement can be avoided.

(2) Although the ground terminal includes the protruding pieces in the above embodiment, the protruding pieces can be omitted from the ground terminal in the case of the present invention. The protruding pieces may be omitted if the ground terminal can resiliently hold the separation wall in a wall thickness direction.

(3) Although the ground terminal fitting portion is provided by recessing the upper surface, the rear end and the lower surface of the separation wall in the above embodiment, the ground terminal fitting portion can be omitted from the ground terminal mounting portion in the case of the present invention. Further, if the protruding pieces are omitted from the ground terminal as described in (2) above, the slit grooves can be omitted from the separation wall. Thus, it is also possible not to apply any special processing to the separation wall as the ground terminal mounting portion.

(4) The structure of the shield terminal of the present invention is arbitrary. For example, the outer conductor may be an integral outer conductor which is vertically undividable. Further, the dielectric may also be an integral dielectric which is vertically undividable.

LIST OF REFERENCE SIGNS

10 . . . housing (connector housing)
14 . . . cavity
18 . . . ground plate mounting portion
21 . . . separation wall
26 . . . ground terminal mounting portion
30 . . . shielded cable
40 . . . shield terminal
41 . . . inner conductor
42 . . . dielectric
43 . . . outer conductor
70 . . . ground terminal
71 . . . outer conductor contact piece
72 . . . ground plate contact piece
73 . . . coupling piece
76 . . . upper surface portion (surface portion on cavity side)
77 . . . lower surface portion (surface portion on ground plate side)
100 . . . ground plate

The invention claimed is:

1. A shield connector, comprising:

a shield terminal including an inner conductor, a dielectric surrounding the inner conductor and an outer conductor surrounding the dielectric;

a connector housing including a cavity for accommodating the shield terminal, a ground plate mounting portion, a ground plate being mounted into the ground plate mounting portion, and a separation wall separating the ground plate mounting portion and the cavity; and a ground terminal arranged across the separation wall and including an outer conductor contact piece configured to contact the outer conductor by entering the cavity, a ground plate contact piece configured to contact the ground plate by entering the ground plate mounting portion and a coupling piece coupling the ground plate contact piece and the outer conductor contact piece;

the ground plate contact piece and the outer conductor contact piece extending deflectably in a direction away from the separation wall with the coupling piece located therebetween, the separation wall of the connector housing being formed with a pair of left and right slit grooves, the ground terminal including a pair of protruding pieces protruding toward both left and right sides of the coupling piece, the pair of protruding pieces being inserted into the pair of slit grooves to be locked to the separation wall.

2. The shield connector of claim 1, wherein the coupling piece resiliently sandwiches the separation wall in a wall thickness direction and includes a ground plate side surface portion and a cavity side surface portion to be arranged along a surface of the separation wall on the ground plate mounting portion side and a wall surface of the separation wall on the cavity side, and each of the ground plate contact piece and the outer conductor contact piece is connected to one end of the corresponding one of the ground plate side and cavity side surface portions.

* * * * *